United States Patent [19]

Hammarberg

[11] Patent Number: 4,514,258

[45] Date of Patent: Apr. 30, 1985

[54] REINFORCED WOOD PARTICLE BOARD AND A METHOD OF PRODUCING IT

[76] Inventor: Lars Hammarberg, Avant. Poste 3, CH-1005 Lausanne, Switzerland

[21] Appl. No.: 403,668

[22] PCT Filed: Dec. 7, 1981

[86] PCT No.: PCT/SE81/00358

§ 371 Date: Jul. 30, 1982

§ 102(e) Date: Jul. 30, 1982

[87] PCT Pub. No.: WO82/01849

PCT Pub. Date: Jun. 10, 1982

[30] Foreign Application Priority Data

Dec. 5, 1980 [SE] Sweden ..... 8008552

[51] Int. Cl.[3] ..... D21H 3/82

[52] U.S. Cl. ..... 162/107; 162/108; 162/123; 162/129; 162/150

[58] Field of Search ..... 162/104, 108, 107, 10–13, 162/150, 123, 129, 132, 322; 428/537, 293; 156/62.2

[56] References Cited

U.S. PATENT DOCUMENTS

| | | | |
|---|---|---|---|
| 2,653,090 | 9/1953 | Crandall | 162/107 |
| 2,881,072 | 4/1959 | Clark | 162/104 |
| 3,303,089 | 2/1967 | Roubicek | 162/142 |
| 3,867,252 | 2/1975 | Skrabak et al. | 162/124 |

FOREIGN PATENT DOCUMENTS

| | | | |
|---|---|---|---|
| 202754 | 3/1955 | Australia | 162/107 |
| 2642168 | 4/1977 | Fed. Rep. of Germany | 162/322 |

*Primary Examiner*—Peter Chin

*Attorney, Agent, or Firm*—Ostrolenk, Faber, Gerb & Soffen

[57] ABSTRACT

The invention relates to particle boards, e.g. wood particle- or chipboards, for building purposes, which have been reinforced by means of glass fibre filaments or threads placed in the boards. The threads are laid to obtain increased rupture strength and increased resistance to punch-through of concentrated loads, and are fixed at given spacing in conjunction with the board manufacturing process. The method of reinforcing the boards during manufacture is also included by the invention.

18 Claims, No Drawings

REINFORCED WOOD PARTICLE BOARD AND A METHOD OF PRODUCING IT

The present invention relates to the reinforcement of wood particle boards by means of reinforcing filaments of threads suitably fixed therein, and a method of reinforcing wood particle boards, e.g. for use as roofing boards directly against roofing trusses. The characterizing features of these reinforced wood particle boards and the method used to produce them will be seen from the following description and claims.

Different methods of reinforcing wood particle boards are already known, e.g. from the Swedish published specifications Nos. 7600758-2 and 7612014-6. According to these known methods, a reinforcing layer of net or unbleached paper having high tensile strength is used. These layers are glued onto the top or bottom faces of the boards in a separate process after manufacturing the boards. Special production lines are used for this process, in which the manufactured and finished boards are reinforced in order to obtain properties increasing their strength.

These known methods all have the drawback that the movement or creep of the reinforcing material, due to the effects of moisture and heat, deviates from that of the board material itself. As a result of the reinforcing material being applied to one side of the board, a so-called "bimetal" effect occurs, manifesting itself by the board becoming warped. The thinner the board is, the greater is this deformation, partly for reasons of geometry, and partly because thinner boards have, per se, less resistance to bending. This effect is apparent when the boards are painted, for example, a thin coat of paint being sufficient to cause deformation.

It has now been found that a very high rupture strength can be obtained for the wood particle board if, in accordance with the present invention, it is provided with interior reinforcement comprising glass fibre filaments or threads in conjunction with the manufacturing process for it. These threads, preferably gathered into clusters or bundles, are laid parallel, with constant or varying mutual spacing and are advanced continuously from bobbins onto a continuously advancing bottom web of the fibre of the fibre stock from which the board is formed, synchronous with the formation of the wet fibrous web, but before applying the top web of fibrous stock forming the whole of the still unfinished board. During subsequent dewatering and pressing steps, the threads are thus embedded and fixed between the top and bottom webs of material forming the board. Reinforcement over a larger surface area than would otherwise be obtained may be provided by laying the threads in a wavy and sinusoidal pattern.

The spacing of the threads to suit requirements relating to rupture strength as well as to the manufacturing process and cost of material has also been found to have great importance. While too large a distance between the threads or bunches thereof does not provide the desired reinforcing effect on the one hand, very small spacing gives raise to such practical drawbacks as excessive weight and material cost on the other hand. Furthermore, it has been found that if thread spacing is reduced to 10 mm or less, dewatering problems which cannot be ignored occur in the pressing step of the manufacturing process. Too closely laid reinforcing threads will thus delay the departure of water, and in some cases there may even be certain bursting effects in the board when pressure is released.

Although the kind of board dealt with here can take up quite large stresses in the direction of its surface, it is susceptible to loads perpendicular thereto, particularly concentrated loads. Thus, in many uses of the boards, such as for roofing or false sealings, there is always the risk of a punch-through, i.e. local rupture or collapse of the board due to a concentrated load, e.g. such as is caused by the weight of a person, or dropping a heavy tool.

It has thus been found that suitable spacing of the threads (measured between the centre lines of adjacent threads or clusters of filaments) should not fall below 10 mm. On the other hand, to avoid punching-through and to maintain rupture strength, this distance should not exceed 80–100 mm. In practice, a spacing (as just defined) between a minimum of about 20 mm and a maximum of about 60 mm should be selected, the selection being made to given an optimum distance in respect of pertinent rupture strength demands and extra cost of reinforcemenet. A spacing of about 40 mm has accordingly been found to be suitable for boards thus reinforced in accordance with the invention, for use as false ceiling boards.

Reinforcement at the edges of the board is of great benefit to nailing strength, and since location of the reinforcing threads is optional, they may be placed in the vicinity of the edges in the rolling direction. This advantage is particularly noticeable with said edges which are given a lower volumetric weight than the rest of the material during the pressing operation during manufacture, thus giving the material deteriorated strength along a margin of about 2–3 cm, which is troublesome in conventional boards. Thus, with reinforcement in the vicinity of the edges of the board, the tendency thereof to tear away from the shank of the nail for a large load if the nail is to near the edge is obviated, as well as substantially reducing the tendency of the nail to pull through the board axially to the nail for an adjacent concentrated load urging the board away from its substructure. Accordingly, the problems of attaching the board to a substructure are thus greatly reduced or solved by the inventive reinforcing method with reinforcing material embedded in, and adhered to the wood particle material of the board. Since nails can be driven closer to the edges of the board without the risks just mentioned, the overlap of the boards at the trusses can be reduced to a minimum, which results in maximum utilization of board area. Reinforcement in accordance with the invention also has the advantage that when it is used, e.g. in connection with boards for false ceilings, about 50% of the wood fibre normally used can be saved, since board thickness may be reduced from 4.5 mm for conventional boards without reinforcement to 3 mm for reinforced boards. This saving of $\frac{1}{3}$ of the material corresponds to about 10,000 tonnes of wood fibre particle per year in Sweden at the present rate of housing production.

To ensure that the glass fibre threads are well fixed in the board material, the threads are suitably treated with a substance such as latex, resins, polyvinyl acetate (PVA) or the like, which can be thermosetting, before or in conjunction with embedding in the board material. A PVA adhesive in an aqueous emulsion and with a somewhat increased water content (about 40–60%) has given a very good bonding effect for the purpose.

Roughing-up the glass fibre threads can also provide increased adherence.

In laboratory experiments for comparing the ultimate strength of conventional boards without reinforcement with the same kinds provided with such in accordance with the invention, the following results have been obtained:

| Sample | Board thickness | Reinforcement | Adhesive treatment | Relative ult. strength |
|---|---|---|---|---|
| A. | 3.2 mm | None | None | 102 |
| B. | 3.1 mm | None | None | 98 |
| C. | 3.0 mm | Glass fibre, untreated | None | 104 |
| D. | 3.0 mm | Glass fibre, R 1410 | None | 127 |
| E. | 3.0 mm | Glass fibre, RPA 38 | None | 121 |
| F. | 3.1 mm | Glass fibre, | PVA glue | 139 |
| G. | 3.1 mm | Glass fibre, | PVA glue | 142 |
| H. | 3.1 mm | Glass fibre, | PVA glue | 150 |
| I. | 3.1 mm | Glass fibre, | PVA glue | 138 |

The ultimate strength given in the table is a relative number, where 100 has been taken as the relative number for the mean value of the ultimate strength of conventional 3 mm boards with no reinforcement. In the experiments under discussion, this value represents a pressure of just 150 kp/dm$^2$ for achieving a rupture of simulated punch-through. As will be seen, inventive reinforcing of a board with the same thickness as those without reinforcement results in up to a 50 percent increase in ultimate strength. The results which are clearly the best are those from boards having reinforcement from glass fibre treated with adhesive, which in the experiments accounted for was a water-emulsified PVA adhesive with about 55% water content.

Since security against rupture and punching-through is the primary reason for reinforcement, it is a great advantage that the latter is placed in the board and cannot be damaged or become detached from the board in some way, due to dampness or handling on the building site. The choice of glass fibre as reinforcing material has also been made with regard to the fact that this material is resistent to moisture and corrosion, and also because it has a modulus of elasticity (600 k-1,2M kp/cm$^2$) desirably high enough for the purpose. The lack of one or more of the mentioned properties make the use of such threads or filaments from metals; textiles or plastics less suitable as reinforcing material.

The practical utility of the invention is illustrated by the fact that the Regulation by the Swedish Board of Occupational Safety and Health concerning security against punching-through (Notification 75:15) is complied with generously, by using inventive glass fibre reinforcement in hard wood particle board only 3,2 mm thick. A thickness of 4,5 mm for boards without reinforcement is usually required for attaining the same result.

The invention can also be utilized in different types of wood particle board, such as building board and chipboard, where the glass fibre threads are placed in the neutral plane (median plane) of the boards, thereby providing a stiffening effect in respect of bending. This can be particularly valuable for boards used in flooring and shelving, since they can then be made thinner without sacrificing requirements for form stability on being loaded.

The conventional method of first using threads to make netting to form the reinforcing layer is an expensive one, since the netting weaving operation costs about three times more than the original filament or thread reinforcing material. By placing the threads in the wet stock layer there is avoided the disadvantage if first needing to manufacture the netting web. Furthermore, by laying the unbroken thread or filaments without interruption, improved punch-through safety is obtained in as far as the dangerous concentrated loads are taken up over a much greater area than for surface reinforcement, which could only be bonded discontinuously to a board. When thin wood particle board collapses for concentrated load, this takes place in a sudden and irregular manner. The board does not rupture along straight lines. The new method of reinforcement therefore signifies that when an area of the board suddenly ruptures under large sudden load, a plurality of reinforcing threads on either side of the load contribute in arresting a punch-through. The same effect as would be achieved with netting is thus achieved to a certain extent, even though the threads or filaments are laid continuously and parallel in the pulp web.

I claim:

1. A method of producing a wet laid continuous glass fiber thread reinforced wood particle board comprising, coating the glass fiber threads with an adhesive, dewatering an aqueous wood particle stock to form a first wet layer of wood particles, continuously applying said coated glass fiber threads onto said first wet layer of wood particles at a side to side spacing of between about 10 mm to about 100 mm, applying a second wet layer of wood particle stock on said coated glass fiber threads and first wood particle layer whereby said coated glass fiber threads are embedded and fixed between said first and second wood particle layer pressing to form said board.

2. A relatively stiff wood particle board produced by the method of claim 1.

3. A board as claimed in claim 1, characterized in that the threads comprise clusters or bundles of glass fibre filaments having a modulus of elasticity exceeding 600.000 kp/cm$^2$.

4. A board as claimed in claim 1 or 2, characterized in that the centre to centre distance between adjacent glass fibre threads is not less than 20 mm.

5. A board as claimed in claim 1 or 2, characterized in that the centre to centre distance between adjacent glass fibre threads does not exceed 60 mm.

6. A board as claimed in claim 1, characterized in that the adhesive comprises a PVA emulsion adhesive with a water content of 40–60% at the time of its application.

7. A board as claimed in claim 1, characterized in that the reinforcing threads are disposed over the entire surface of the board.

8. A board as claimed in claim 1, characterized in that the reinforcing threads are disposed substantially solely at selected edge portions of the board.

9. A board as claimed in claim 1, characterized in that the reinforcing threads are situated closer to the medial plane of the board than to the major surfaces thereof, thereby smoothing out possible differences in the expansion properties of the board material and reinforcing threads.

10. A board as claimed in claim 3, characterized in that the adhesive comprises a PVA emulsion adhesive with a water content of 40–60% at the time of its application.

11. A board as claimed in claim 3, characterized in that the reinforcing threads are disposed over the entire surface of the board.

12. A board as claimed in claim 3, characterized in that the reinforcing threads are disposed substantially solely at selected edge portions of the board.

13. A board as claimed in claim 3, characterized in that the reinforcing threads are situated closer to the medial plane of the board than to the major surfaces thereof, thereby smoothing out possible differences in the expansion properties of the board material and reinforcing threads.

14. A board as claimed in claim 1 characterized in that the centre to centre distance between adjacent glass fibre threads is in the range of 20–60 mm.

15. A board as claimed in claim 14, characterized in that the threads comprise clusters or bundles of glass fibre filaments having a modulus of elasticity exceeding 600.000 kp/cm$^2$.

16. A board as claimed in claim 14, characterized in that the adhesive comprises a PVA emulsion adhesive with a water content of 40–60% at the time of its application.

17. A board as claimed in claim 1, characterized in that the reinforcing threads are disposed substantially solely at selected edge portions of the board.

18. A board as claimed in claim 14, characterized in that the reinforcing threads are situated closer to the medial plane of the board than to the major surfaces thereof, thereby smoothing out possible differences in the expansion properties of the board material and reinforcing threads.

* * * * *